US009186679B2

(12) United States Patent
Pan

(10) Patent No.: US 9,186,679 B2
(45) Date of Patent: Nov. 17, 2015

(54) AUTOMATIC FEED PAPER SHREDDER WITH IMPROVED PAPER PRESSING MECHANISM

(71) Applicant: Dongguan Futai Electronic Co., Ltd., Dongguan, Guangdong (CN)

(72) Inventor: Guofeng Pan, Guangdong (CN)

(73) Assignee: DONGGUAN FUTAI ELECTRONIC CO., LTD., Dongguan, Guangdong (CN)

( * ) Notice: Subject to any disclaimer, the term of this patent is extended or adjusted under 35 U.S.C. 154(b) by 247 days.

(21) Appl. No.: 13/719,532

(22) Filed: Dec. 19, 2012

(65) Prior Publication Data

US 2013/0161425 A1 Jun. 27, 2013

(30) Foreign Application Priority Data

Dec. 21, 2011 (CN) ..... 2011 2 0539259 U

(51) Int. Cl.
*B02C 23/00* (2006.01)
*B02C 18/22* (2006.01)
*B02C 18/00* (2006.01)

(52) U.S. Cl.
CPC ..... *B02C 18/2233* (2013.01); *B02C 18/0007* (2013.01)

(58) Field of Classification Search
CPC ..... B02C 18/2225; B02C 18/2233; B02C 18/2291; B02C 18/0007
USPC ..... 241/34, 285.1; 74/519–521; 100/266, 100/280–281
See application file for complete search history.

(56) References Cited

U.S. PATENT DOCUMENTS

| | | | | |
|---|---|---|---|---|
| 2005/0274836 | A1* | 12/2005 | Chang | 241/236 |
| 2006/0249609 | A1* | 11/2006 | Huang | 241/224 |
| 2007/0181722 | A1* | 8/2007 | Dahle et al. | 241/235 |
| 2011/0253819 | A1* | 10/2011 | Aries et al. | 241/100 |
| 2011/0253824 | A1* | 10/2011 | Aries et al. | 241/222 |
| 2011/0303775 | A1* | 12/2011 | Kim | 241/34 |
| 2012/0018554 | A1* | 1/2012 | Seo et al. | 241/101.2 |
| 2013/0161424 | A1* | 6/2013 | Pan | 241/34 |
| 2013/0214071 | A1* | 8/2013 | Kao | 241/34 |
| 2014/0042254 | A1* | 2/2014 | Zhan | 241/34 |
| 2014/0048637 | A1* | 2/2014 | Zhang | 241/285.1 |

* cited by examiner

*Primary Examiner* — Faye Francis
*Assistant Examiner* — Leonel Vasquez
(74) *Attorney, Agent, or Firm* — Jackson IPG PLLC; Demian K. Jackson

(57) ABSTRACT

An automatic feed paper shredder with an improved paper pressing mechanism, including a paper shredding device, openable flip covers and elastic supports, wherein one side of the flip cover is hinged to the paper shredding device; the flip cover are disposed above the paper shredding device; a paper placing platform and a paper inlet opening are disposed on the top of the paper shredding device; automatic paper winders are disposed at both sides of the paper inlet opening; a pressboard is disposed at the bottom of each flip cover; and one side of each elastic support is connected with the flip cover and the other side of each elastic support is connected with the flip cover and the other side of each elastic support is connected with the pressboard.

8 Claims, 3 Drawing Sheets

AUTOMATIC FEED PAPER SHREDDER WITH IMPROVED PAPER PRESSING MECHANISM

FIELD OF THE INVENTION

The invention relates to the technical field of paper shredders, in particular to an automatic paper feed shredder for an improved paper pressing mechanism.

BACKGROUND OF THE INVENTION

In the prior art, due to the requirement of information privacy, paper shredders are produced for the enhancement of information privacy. However, in the case of a large amount of paper required to be shredded, users need to manually feed documents and the like into the paper shredders, which wastes a lot of time, and consequently automatic paper feed shredders are produced.

An automatic paper shredder comprises a flip cover, wherein a pressboard is disposed at the bottom of the flip cover; and a compression spring is disposed between the pressboard and the flip cove. Pressure is applied to the pressboard by the compression spring and the pressboard presses and covers paper on a paper placing platform of the shredder after the flip cover of the shredder is closed and applies pressure to the paper, so that the paper at the bottom of the paper placing platform can be winded into a paper inlet opening by an automatic paper winder of the shredder.

Moreover, as the elastic force of the compression spring is in direct proportion with the deformation length of the compression spring, the pressure applied to the paper with different thicknesses on the paper placing platform by the pressboard is different. In the case of thin paper, the pressure applied to the paper by the pressboard is very low, which is unfavorable for the automatic paper winder to wind the paper into the paper inlet opening. In the case of thick paper, the pressure applied to the paper by the pressboard is very large, which is also unfavorable for the automatic paper winder to wind the paper into the paper inlet opening. Therefore, the automatic paper feed shredder in the prior art must be improved.

SUMMARY OF THE INVENTION

The objective of the invention is to overcome the defects in the prior art and provide an automatic paper feed shredder for an improved paper pressing mechanism, wherein the variation range of the acting force applied to paper with different thicknesses on a paper placing platform by a pressboard is small, so that the paper can be stably and smoothly winded into a paper inlet opening by an automatic paper winder or automatic paper winders.

In order to achieve the objective, the invention adopts the technical proposal that:

The invention discloses an automatic paper feed shredder for an improved paper pressing mechanism, which comprises a paper shredding device, an openable flip cover and at least one elastic support, wherein one side of the flip cover is hinged to the paper shredding device; the flip cover is disposed above the paper shredding device by covering; a paper placing platform and a paper inlet opening are disposed on the top of the paper shredding device; an automatic paper winder is disposed at one side of the paper inlet opening or automatic paper winders are disposed at both sides of the paper inlet opening; a pressboard is disposed at the bottom of the flip cover; and one side of the elastic support is connected with the flip cover and the other side of the elastic support is connected with the pressboard.

The paper inlet opening is disposed in the middle of the paper placing platform; two flip covers are disposed above the paper shredding device; the outsides of the two flip covers are hinged to the outside of the paper shredding device respectively; and the insides of the two flip covers are pieced together in the middle of the paper shredding device.

An elastic support is disposed on both sides of each flip cover respectively.

Each elastic support has a first support, a second support, a pin and a torsion spring; a pin hole is formed in the middle of the first and second supports respectively; the pin passes through the pin holes of the first and second supports; the torsion spring is sleeved on the pin; both ends of the torsion spring are lapped over the first and second supports respectively; upper ends of the first and second supports are connected to the flip cover respectively; and lower ends of the first and second supports are connected to the pressboard respectively.

Both ends of the torsion spring are lapped over same sides of the first and second supports respectively.

The first and second supports are connected with each other in the shape of X.

A guiding groove is formed in the middle of the pressboard; and one end of the pin passes through the guiding groove.

A strut is disposed on outer ends of the first and second supports respectively; an upper chute is formed at the bottom of the flip cover; a lower chute is formed on the upper surface of the pressboard; the struts on the upper ends of the first and second supports pass through the upper chute of the flip cover; and the struts on the lower ends of the first and second supports pass through the lower chute of the pressboard.

An upper guiding element is disposed at the bottom of the flip cover; the upper chute is disposed under the upper guiding element; a lower guiding element is disposed on the upper surface of the pressboard; the lower chute is disposed under the lower guiding element; and the width of the upper chute and the width of the lower chute are more than or equal to the transversal displacement of the struts respectively.

The upper chute is perpendicular to the flip cover; the lower chute is perpendicular to the pressboard; the upper chute is provided with a sliding space for the struts on the upper ends of the first and second supports to slide in the direction perpendicular to the flip cover; and the lower chute is provided with a sliding space for the struts on the lower ends of the first and second supports to slide in the direction perpendicular to the pressboard.

The automatic paper feed shredder for the improved paper pressing mechanism adopting the technical proposal has the advantages that: due to the elastic supports, the variation range of the acting force applied to paper with different thicknesses on the paper placing platforms by the pressboards is small, and thus the friction force applied to the paper with different thicknesses on the paper placing platforms by the automatic paper winder(s) is basically the same. Therefore, the operation reliability of automatic paper feed can be improved and the paper can be stably and smoothly winded into the paper inlet opening by the automatic paper winder(s).

DETAILED DESCRIPTION OF THE PREFERRED EMBODIMENTS

Figure 1:
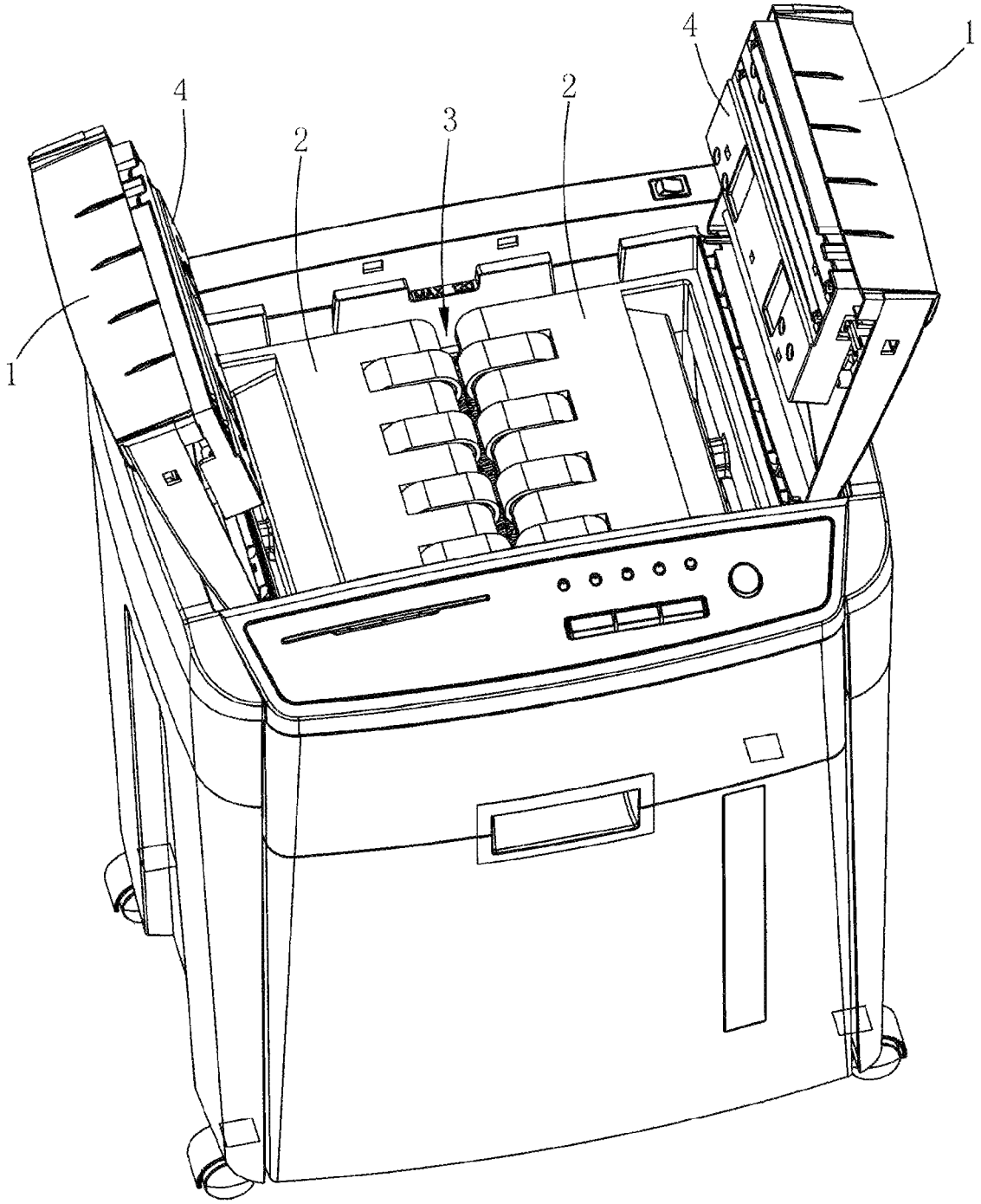
FIG. 1 is a structure diagram of the automatic paper feed shredder provided by the invention.
Figure 2:
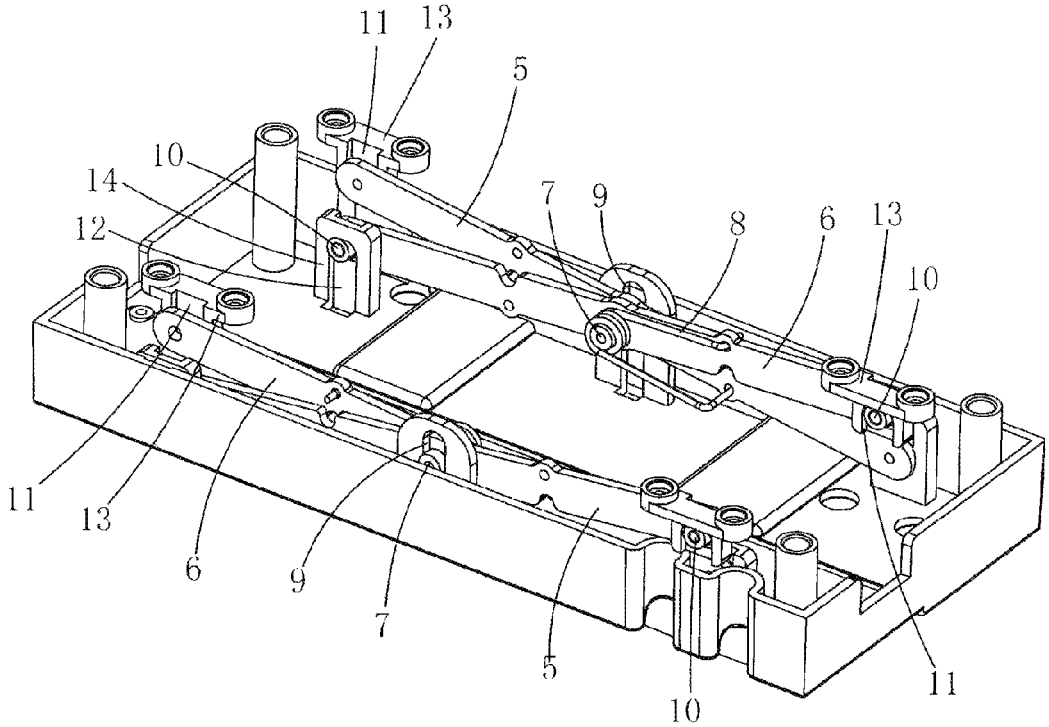
FIG. 2 is a structure diagram of a pressboard for the automatic paper feed shredder provided by the invention.
Figure 3:
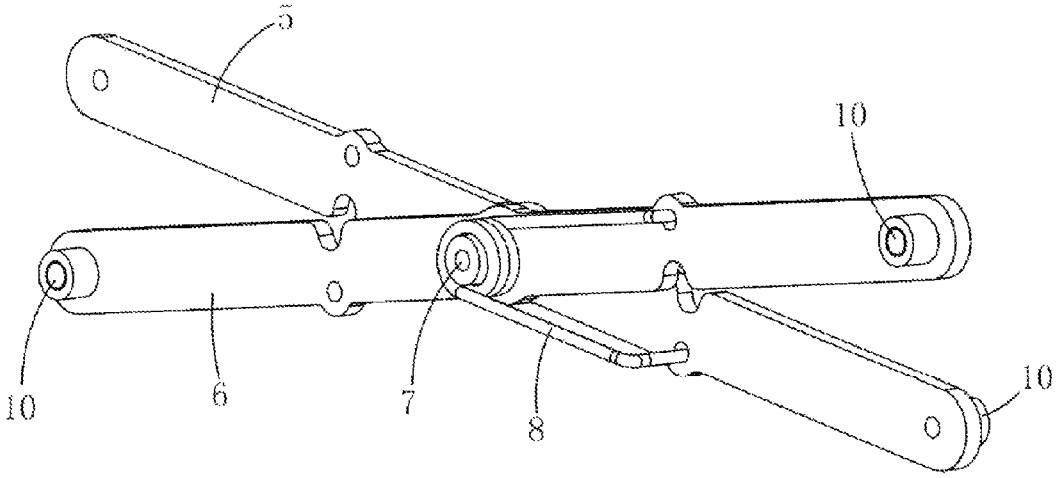
FIG. 3 is a structure diagram of first and second supports for the automatic paper feed shredder provided by the invention.

The invention discloses an automatic paper feed shredder for an improved paper pressing mechanism, which comprises a paper shredding device, an openable flip cover 1 and at least one elastic support, wherein one side of the flip cover 1 is hinged to the paper shredding device; the flip cover 1 is disposed above the paper shredding device by covering; a paper placing platform 2 and a paper inlet opening 3 are disposed on the top of the paper shredding device; an automatic paper winder is disposed at one side of the paper inlet opening 3 or automatic paper winders are disposed at both sides of the paper inlet opening 3; a pressboard 4 is disposed at the bottom of the flip cover 1; and one side of the elastic support is connected with the flip cover 1 and the other side of the elastic support is connected with the pressboard 4. Due to the elastic support, the variation range of the acting force applied to paper with different thicknesses on the paper placing platform 2 by the pressboard 4 is small, so that the paper can be stably and smoothly winded into the paper inlet opening by the automatic paper winder(s).

The paper inlet opening 3 is disposed in the middle of the paper placing platform 2; two flip covers 1 are disposed above the paper shredding device; the outsides of the two flip covers 1 are hinged to the outside of the paper shredding device respectively; and the insides of the two flip covers 1 are pieced together in the middle of the paper shredding device. Moreover, an elastic support is disposed on both sides of each flip cover 1 respectively.

Each elastic support has a first support 5, a second support 6, a pin 7 and a torsion spring 8; a pin hole is formed in the middle of the first support 5 and the second support 6 respectively; the pin 7 passes through the pin holes of the first support 5 and the second support 6; the torsion spring 8 is sleeved on the pin 7; both ends of the torsion spring 8 are lapped over the first support 5 and the second support 6 respectively; upper ends of the first support 5 and the second support 6 are connected to the flip cover 1 respectively; and lower ends of the first support 5 and the second support 6 are connected to the pressboard 4 respectively.

The elastic deformation force of the torsion spring 8 is not sensitive to the height variation of the elastic support and the variation range of the elastic force of the torsion spring 8 is small during the height variation of the elastic support between the maximum height and the minimum height. Therefore, the acting force applied to the paper with different thicknesses on the paper placing platform 2 by the pressboard 4 has little difference, and then the variation range of the pressure applied to the paper with different thicknesses by the pressboard 4 is very small, and thus the friction force applied to the paper with different thicknesses on the paper placing platform 2 by the automatic paper winder(s) is basically the same. And consequently the operation reliability of automatic paper feed can be improved.

Both ends of the torsion spring 8 are lapped over same sides of the first support 5 and the second support 6 respectively. The first support 5 and the second support 6 are connected with each other in the shape of X. A torsional force is applied to the first support 5 and the second support 6 by the torsion spring 8, so that the first support 5 and the second support 6 are maintained to be stretched out and pressure can be applied to the paper with different thicknesses on the paper placing platform 2 by the pressboard 4.

A guiding groove 9 is formed in the middle of the pressboard 4; and one end of the pin 7 passes through the guiding groove 9. Therefore, the equilibrium of the elastic support can be improved.

A strut 10 is disposed on outer ends of the first support 5 and the second support 6 respectively; an upper chute 11 is formed at the bottom of the flip cover 1; a lower chute 12 is formed on the upper surface of the pressboard 4; the struts 10 on the upper ends of the first support 5 and the second support 6 pass through the upper chute 11 of the flip cover 1; and the struts 10 on the lower ends of the first support 5 and the second support 6 pass through the lower chute 12 of the pressboard 4. Moreover, an upper guiding element 13 is disposed at the bottom of the flip cover 1; the upper chute 11 is disposed under the upper guiding element 13; a lower guiding element 14 is disposed on the upper surface of the pressboard 4; the lower chute 12 is disposed under the lower guiding element 14; and the width of the upper chute 11 and the width of the lower chute 12 are more than or equal to the transversal displacement of the struts 10 respectively. Furthermore, the upper chute 11 is perpendicular to the flip cover 1; the lower chute 12 is perpendicular to the pressboard 4; the upper chute 11 is provided with a sliding space for the struts 10 on the upper ends of the first support 5 and the second support 6 to slide in the direction perpendicular to the flip cover 1; and the lower chute 12 is provided with a sliding space for the struts 10 on the lower ends of the first support 5 and the second support 6 to slide in the direction perpendicular to the pressboard 4. The upper chute 11 and the lower chute 12 provide a moving space for the struts 10 in the width direction and the length direction respectively, and the rotation of the first support 5 and the second support 6 is not affected.

The above illustrated is only the preferred embodiments of the invention. Changes can be made on the specific implementations and the application range by those skilled in the art on the basis of the concept of the invention. The content of the Description shall not be construed as a limit to the invention.

What is claimed is:

1. An automatic feed paper shredder with an improved paper pressing mechanism, comprising a paper shredding device;

two openable flip covers, wherein one side of each flip cover is hinged to the paper shredding device and each flip cover is disposed above the paper shredding device;

a paper placing platform disposed on a top of the paper shredding device;

a paper inlet opening disposed on the top of the paper shredding device;

two automatic paper winders disposed on both sides of the paper inlet opening;

a pressboard disposed at a bottom of each flip cover;

elastic supports, each elastic support having one side connected with a respective flip cover and the other side connected with a respective pressboard and wherein each elastic support comprises:

a first support with a pin hole formed in a middle of the first support, a second support with a pin hole formed in a middle of the second support, a pin extending through the pin holes of the first and second supports so as to pivotably connect the first and second supports, and a torsion spring sleeved on the pin and with each of two opposite ends of the torsion spring connected with the first and second supports respectively and wherein upper ends of the first and second supports are connected to the respective flip cover and lower ends of the first and second supports are connected to the respective pressboard.

2. The automatic feed paper shredder with the improved paper pressing mechanism according to claim 1, wherein the first and second supports are connected with each other in the shape of X.

3. The automatic feed paper shredder with the improved paper pressing mechanism according to claim 1, wherein a guiding groove is formed in the middle of each pressboard; and one end of each pin passes through a respective guiding groove.

4. The automatic feed paper shredder with the improved paper pressing mechanism according to claim 1, wherein a strut is disposed on ends of the first and second supports respectively; an upper chute is formed at the bottom of each flip cover; a lower chute is formed on an upper surface of each pressboard; uppermost struts on the ends of the first and second supports pass through the upper chute of the respective flip cover; and lowermost struts on the ends of the first and second supports pass through the lower chute of the respective pressboard.

5. The automatic feed paper shredder with the improved paper pressing mechanism according to claim 4, wherein an upper guiding element is disposed at the bottom of each flip cover; the upper chute is disposed under the upper guiding element; a lower guiding element is disposed on the upper surface of each pressboard; the lower chute is disposed under the lower guiding element; a width of the upper chute and a width of the lower chute are more than or equal to a transversal displacement of the struts respectively.

6. The automatic feed paper shredder with the improved paper pressing mechanism according to claim 5, wherein each upper chute is perpendicular to the respective flip cover; each lower chute is perpendicular to the respective pressboard; each upper chute is provided with a sliding space for the struts on the upper ends of the first and second supports to slide in the direction perpendicular to the flip cover; and each lower chute is provided with a sliding space for the struts on the lower ends of the first and second supports to slide in the direction perpendicular to the pressboard.

7. The automatic feed paper shredder with the improved paper pressing mechanism according to claim 1, wherein the paper inlet opening is disposed in a middle of the paper placing platform.

8. The automatic feed paper shredder with the improved paper pressing mechanism according to claim 1, wherein a first and a second of the elastic supports is disposed on both of two opposite sides of each flip cover respectively.

* * * * *